US006474607B1

(12) United States Patent
Wilson

(10) Patent No.: US 6,474,607 B1
(45) Date of Patent: Nov. 5, 2002

(54) PAINT CONTAINER SUPPORT DEVICE

(76) Inventor: Michael J. Wilson, 6785 Indian Hills Dr., Fulton, IL (US) 61252

( * ) Notice: Subject to any disclaimer, the term of this patent is extended or adjusted under 35 U.S.C. 154(b) by 0 days.

(21) Appl. No.: 10/004,673

(22) Filed: Dec. 4, 2001

(51) Int. Cl.[7] ..... E06C 7/14
(52) U.S. Cl. ..... 248/211; 182/129
(58) Field of Search ..... 248/211, 238, 248/210; 182/121, 129

(56) References Cited

U.S. PATENT DOCUMENTS

| | | | | |
|---|---|---|---|---|
| 2,855,170 A | * | 10/1958 | Spinello | 248/211 |
| 2,912,204 A | | 11/1959 | Raysinger | |
| 3,163,389 A | | 12/1964 | Thornburgh | |
| 3,448,956 A | | 6/1969 | Kuhaneck, Jr. | |
| 3,979,097 A | | 9/1976 | Balne | |
| 4,053,131 A | | 10/1977 | Francis | |
| 4,099,693 A | | 7/1978 | Blann | |
| 4,433,822 A | | 2/1984 | Caggiano | |
| 5,133,525 A | | 7/1992 | Good | |
| 5,226,623 A | * | 7/1993 | Hunt et al. | 248/211 |
| 5,716,034 A | | 2/1998 | Unkefer | |
| D393,413 S | | 4/1998 | Brown | |
| 6,250,595 B1 | * | 6/2001 | Campbell | 248/211 |

* cited by examiner

*Primary Examiner*—Ramon O. Ramirez
(74) *Attorney, Agent, or Firm*—Dale J. Ream

(57) ABSTRACT

A paint container support device for use with a ladder having a plurality of rungs includes a hook member having upper and lower portions. The upper portion includes a generally inverted U-shaped configuration whereby the device may be selectively suspended from a ladder rung. The lower portion is configured to receive a bail of a paint container. A body portion is attached to the lower portion of the hook member, the body portion having an elongate rear edge offset and depending from the hook lower portion so as to position a paint container in a generally vertical configuration and generally perpendicular to the container's bail when the bail is received by the lower portion of the hook member. A selected one of a plurality of support strips may be releasably connected along the rear edge to further offset a paint container and regulate its position relative to its bail.

15 Claims, 7 Drawing Sheets

PAINT CONTAINER SUPPORT DEVICE

BACKGROUND OF THE INVENTION

This invention relates to paint container holders and, more particularly, to a device for supporting a paint container from a rung of a ladder and for positioning the container generally perpendicularly to its handle.

Various devices for supporting or suspending paint containers from a rung or rail of a ladder have been proposed in the art. Some devices include a tray or platform for supporting a paint can or a hook member for suspending a paint container from a ladder rung. Although assumably effective for their intended uses, the existing devices do not provide a support device which can either be suspended from a rung either between the ladder rails or outwardly adjacent a respective rail and which positions a paint container and its bail in a generally perpendicular relationship.

Therefore, it is desirable to have a paint container support device which may be suspended from a selected ladder rung or inserted into a rung's hollow interior. Further, it is desirable to have a support device which receives the bail of a paint container and positions the corresponding paint container generally perpendicular to the bail such that the bail is not in the way while dipping a brush into the container. Additionally, it is desirable to have a support device which selectively accommodates paint containers of multiple sizes.

SUMMARY OF THE INVENTION

A paint container support device according to the present invention includes a hook member having an upper portion and a lower portion. The upper portion has a hanger configuration that enables the hook member to be suspended from a rung of a ladder. The lower portion is configured to selectively capture a bail of a paint container. The support device includes a body member connected to the lower portion of the hook member. The body member includes an elongate rear edge slightly offset from the lower portion and extending downwardly therefrom when the hook member is hanging from a rung. Therefore, a paint container may be supported by the hook member when its bail is captured by the lower portion. The rear edge consequently positions the paint container in a generally upright configuration in which the paint container and bail are generally perpendicular to each other.

The device further includes a plurality of support strips, each strip having a unique thickness. Each strip may be selectively and releasably coupled along the rear edge of the body member such that the paint container may be offset a predetermined distance from the body member. This enables paint containers of various sizes to be supported and still maintain the perpendicular relationship between the container and bail.

The paint container support device may also include a holding arm coupled to the body member and which may be inserted into a hollow rung of a ladder such that the device may be positioned outwardly adjacent a ladder rail. The holding arm may be horizontally pivotal such that the device may be inserted along either rail of a ladder.

Therefore, a general object of this invention is to provide a support device for supporting a paint container from a rung of a ladder.

Another object of this invention is to provide a support device, as aforesaid, which holds a paint container and its bail in a substantially perpendicular configuration such that the bail does not obstruct access to the top of the paint container.

Still another object of this invention is to provide a support device, as aforesaid, which displaces a paint container a predetermined distance from the bail capturing portion of the hook member.

A further object of this invention is to provide a support device, as aforesaid, having a holding arm for insertion into a hollow rung of a ladder such that the device is mounted outwardly adjacent a side rail of the ladder.

A still further object of this invention is to provide a support device, as aforesaid, that is simple and inexpensive to manufacture.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
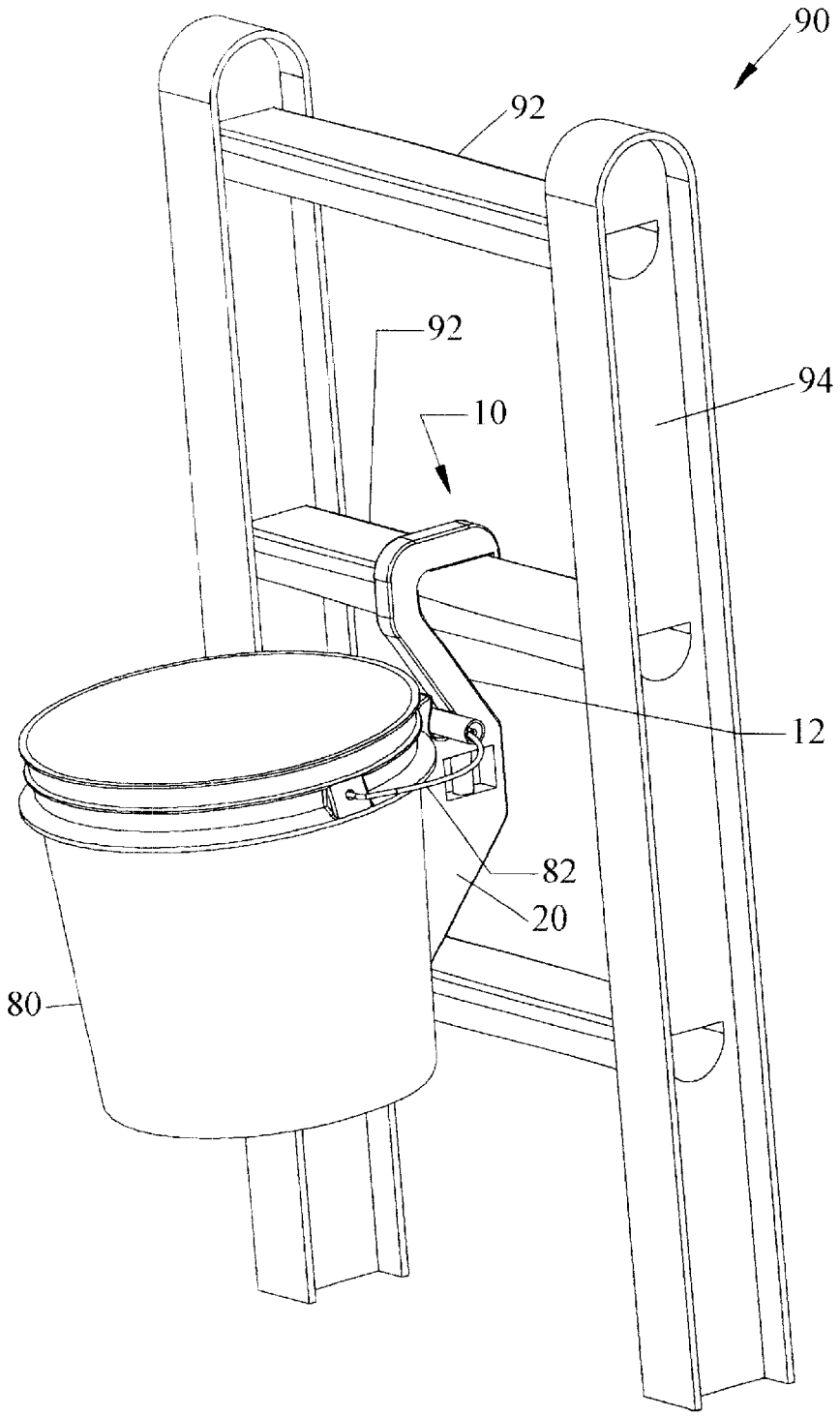
FIG. 1 is a perspective view of a paint container support device according to one embodiment of the present invention in use upon a ladder.
Figure 2:
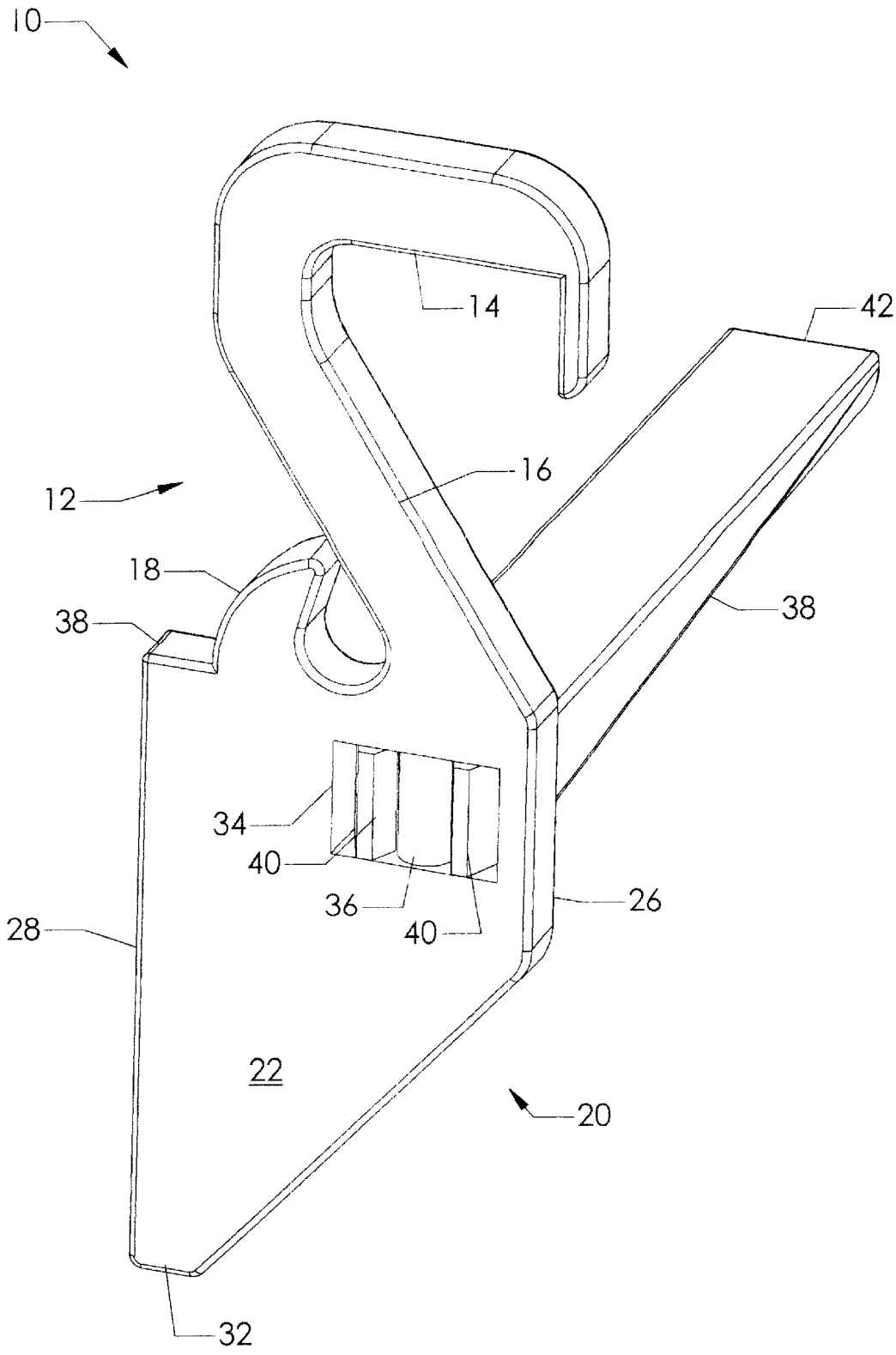
FIG. 2 is a perspective view of the support device as in FIG. 1 having a holding arm.

A paint container support device according to the present invention will now be described with reference to FIGS. 1 through 7 of the accompanying drawings. One embodiment of a paint container support device 10 includes a hook member 12 and a body member 20. More particularly, the hook member 12 includes a generally S-shaped or Z-shaped configuration, depending, of course, from which side it is viewed. The hook member 12 includes an upper portion 14 having a generally inverted U-shaped configuration with an open front substantially similar to the configuration of a clothes hanger (FIG. 2). Therefore, the upper portion 14 may be suspended from a generally round rung of an extension ladder or a flat rung of a stepladder. The hook member 12 further includes a lower portion 16 having a curled tip 18 (FIG. 2) suitable for capturing a bail 82 of a paint container 80 (FIG. 1).

The paint container support device 10 further includes a body member 20 integrally connected to the lower portion 16 of the hook member 12 and depending therefrom (FIG. 2). The body member includes first 22 and second 24 opposed planar side walls extending between elongate front 26 and rear 28 edges. It is understood that the front 26 and rear 28 edges span between the side walls. The front edge 26 corresponds with the front opening of the upper portion 14 (FIG. 2). The body member 20 includes a top edge 30 extending between the curled tip portion of the lower portion 16 of the hook member 12 such that the rear edge 28 is rearwardly offset a predetermined distance therefrom, as to be described more fully below. The front edge 26 may taper or be angled toward the rear edge 28 such that the edges substantially intersect to form a blunt tip 32 at a distal end relative to the hook member 12.

Figure 3:
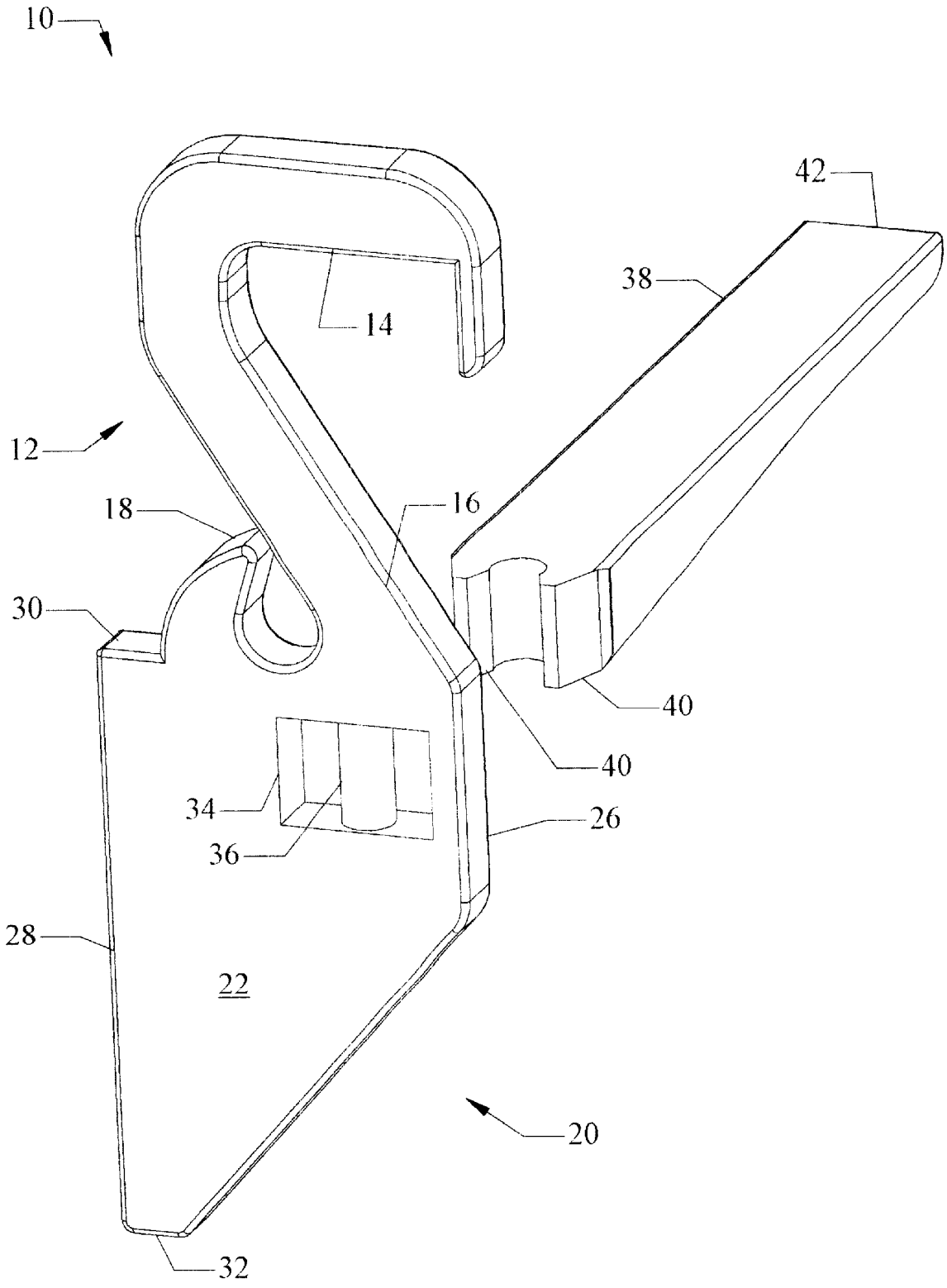
FIG. 3 is a perspective view of the support device as in FIG. 2 with the holding arm released from the body member.
Figure 4:
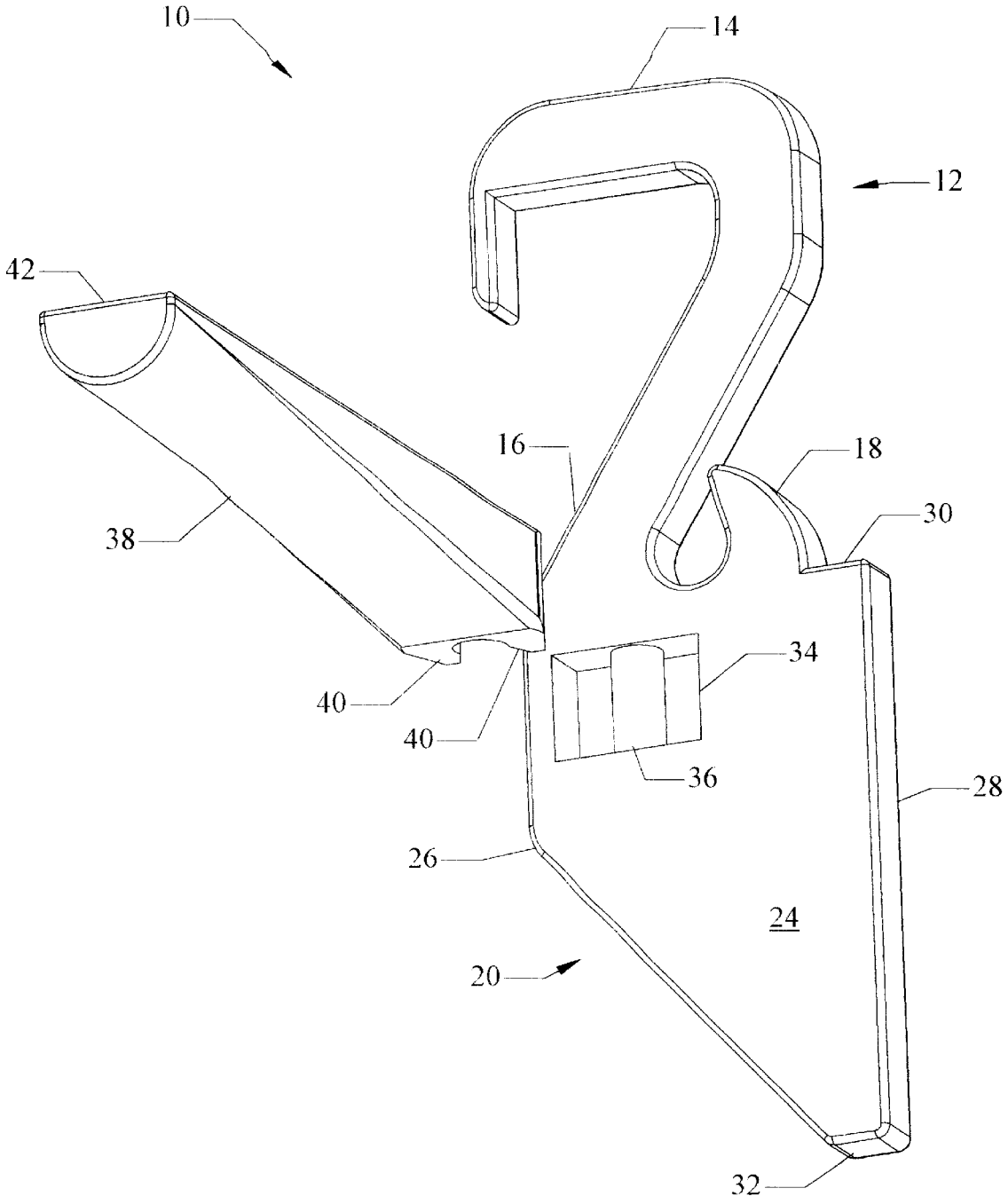
FIG. 4 is perspective view of the support device as in FIG. 3 from another angle.

As shown in FIGS. 2–4, the body member 20 defines a cutout 34 having a generally rectangular configuration although other configurations would be suitable as well. A shaft 36 is fixedly attached in a vertical position within the cutout 34. The support device 10 includes an elongate holding arm 38 having a configuration that is complementary to that of the hollow rungs 92 of a ladder 90. In other words, the holding arm 38 may have a hemispherical lower portion and a planar upper portion having a combined configuration consistent with the rungs of modem extension ladders. Of course, other configurations would also be suitable for use with extension ladders having other rung configurations. The holding arm 38 includes a first end having a pair of prongs 40 configured to releasably engage the shaft 36 in a snap-fit relationship (FIG. 3). The holding arm 38 includes a free second end 42 such that the holding arm 38 may be inserted second end first into a hollow rung 92 of a ladder so as to position the support device 10 outwardly adjacent a respective rail 94 of the ladder 90.

Figure 5:
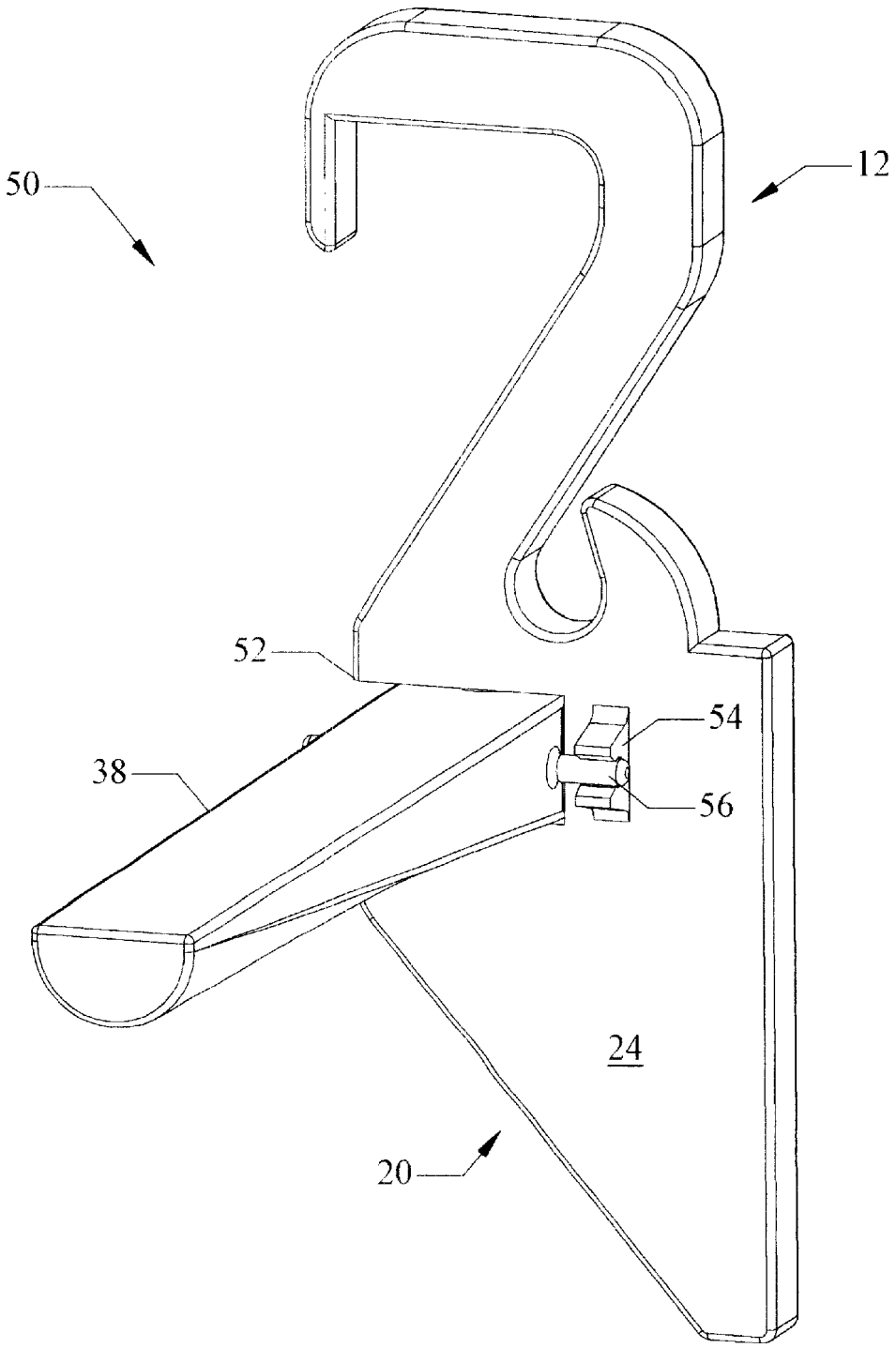
FIG. 5 is a perspective view of a paint container support device according to another embodiment of the present invention.
Figure 6:
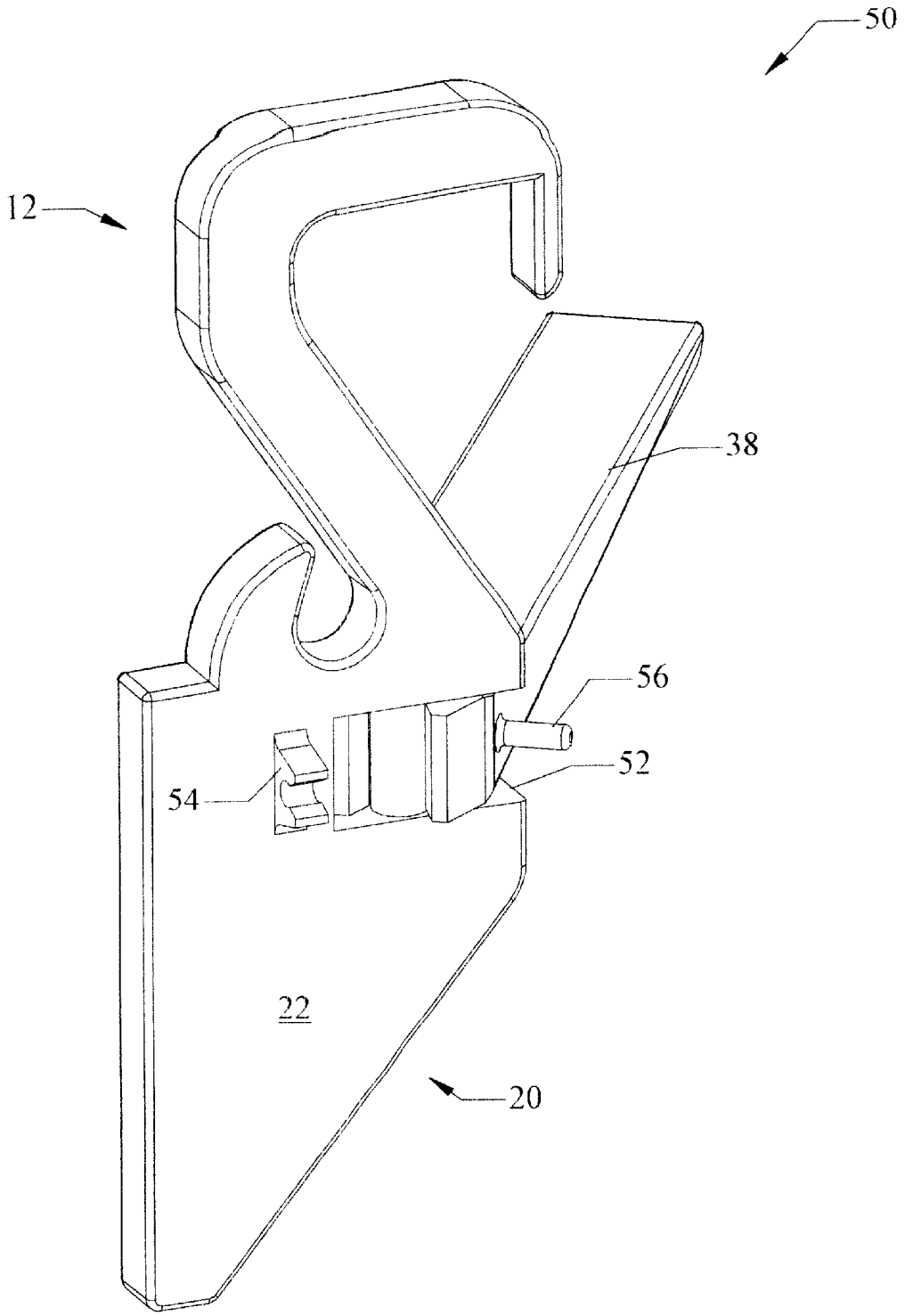
FIG. 6 is another perspective view of the device as in FIG. 5 with the holding arm being pivoted side-to-side.

A paint container support device 50 according to another embodiment of the invention is shown in FIGS. 5 and 6 and has a construction that is substantially similar to that described previously except as specifically noted below, with identical elements being referenced with the same reference numerals used previously. The front edge 26 of the body member 20 according to this embodiment defines an opening 52 in communication with the cutout 34. When the holding arm 38 is snappably coupled to the shaft 36, it is pivotally movable about an imaginary vertical axis defined by the shaft 36. More particularly, the holding arm 38 is pivotal in side-to-side movement between a first configuration normal to the first planar side 22 of the body member 20 and a second configuration normal to the second planar side 24 of the body member. Of course, the holding arm 38 passes through the opening 52 in the front edge 26 of the body member 20 as it is pivoted between the first and second configurations (FIG. 6).

A locking bracket 54 is fixedly attached to each side wall of the body member 20 and positioned between the cutout 34 and rear edge 28 (FIGS. 5 and 6). A post 56 is fixedly attached to each side of the holding arm 38 at a position slightly displaced from the first end thereof. A respective post 56 is releasably received in a respective bracket 54 in a snap-fit relationship when the holding arm 38 is positioned respectively at its first or second configuration.

Figure 7:
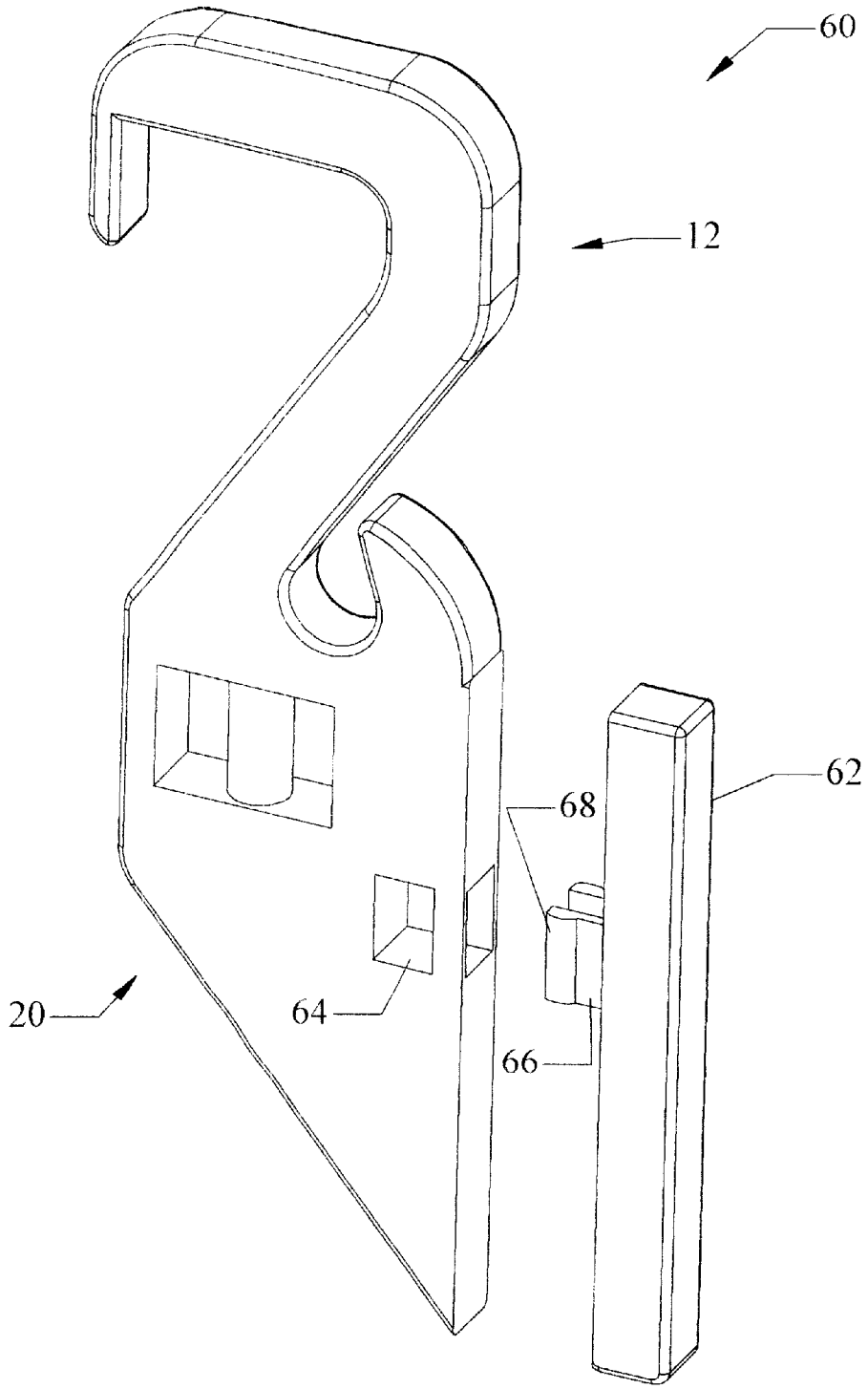
FIG. 7 is an exploded perspective view of a paint container support device according to still another embodiment of the present invention.

A paint container support device 60 according to another embodiment is shown in FIG. 7 and includes a construction that is substantially similar to that described first above except as specifically noted below. This embodiment includes a plurality of elongate support strips 62, each strip having a thickness dimension different from any other of the plurality of support strips 62. The rear edge 28 of the body member defines an opening in communication with another cutout 64 adjacent the rear edge 28. Each strip includes a pair of resilient prongs 66, each prong having an outwardly projecting nub 68. Therefore, a selected support strip 62 may be releasably coupled to the rear edge 28 when the prongs 66 are inserted into the cutout 64 in a snap-fit attachment. Depression of the nubs 68 allows the prongs 66 to be released such that the support strip 62 may be removed and perhaps replaced with a support strip of another thickness.

In use, the paint container support device 10 may be suspended by the upper portion 14 of the hook member 12 from a rung 92 of a ladder 90. Then the bail 82 of a paint container 80 may be received/captured by the curled tip 18 of the lower portion 16 of the hook member 12. With the bail 82 held by the lower portion 16 of the hook member 12, the corresponding paint container 80 rests against the rear edge 28 of the body member 20 in a generally vertical configuration and generally perpendicular to the bail 82 (FIG. 1).

In the FIG. 7 embodiment, support strips 62 coupled along the rear edge 28 displace a paint container 80 a predetermined distance from the body member 20 so as to maintain the perpendicular relationship between the container and bail. Therefore, the attachment of appropriately sized support strips 62 enables paint containers of various sizes to be used with the support device. The embodiment shown in FIGS. 5 and 6 includes a holding arm 38 for insertion into a hollow ladder rung so as to support the device outwardly adjacent a ladder rail 94. The holding arm 38 is pivotal side-to-side such that the device may be used on either side of a ladder 90 while maintaining the hook member 12 in a proper configuration.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A paint container support device for use with a ladder having a plurality of rungs extending between a pair of spaced apart rails, said paint container support device, comprising:

a hook member having an upper portion adapted to selectively engage a rung of the ladder and a lower portion adapted to receive a bail of a paint container;

a body member fixedly attached to said lower portion of said hook member and having an elongate rear edge adapted to support said paint container in a vertical configuration when said bail thereof is received by said lower portion of said hook member; and wherein said rear edge of said body member is rearwardly offset from said lower portion of said hook member such that said bail is held generally perpendicular to said paint container when said bail is received by said lower portion of said hook member.

2. The paint container support device as in claim 1 further comprising an elongate support strip releasably connected to said rear edge and extending longitudinally therealong, said elongate support strip having a thickness for displacing said paint container from said body member such that said bail is held substantially perpendicular relative to said paint container when said bail is received by said lower portion of said hook member.

3. The paint container support device as in claim 1 wherein:

said upper portion of said hook member includes an inverted U-shaped configuration adapted to be releasably suspended from a rung of the ladder; and said body member includes a front edge opposite said rear edge, said front edge tapering inwardly toward said elongate vertical edge such that said rear and front edges intersect at a free end opposite said hook member.

4. The paint container support device as in claim 1 wherein said body member defines a cutout; said paint container support device further comprising:

a shaft positioned in said cutout;

a holding arm having a first end releasably coupled to said shaft and having a second end, said holding arm being configured for insertion second end first into a hollow rung of a ladder, whereby to position said hook and body members outwardly adjacent a respective rail of the ladder.

5. The paint container support device as in claim 4 wherein said body member includes a front edge opposite said rear edge and defining an opening in communication with said cutout, said first end of said holding arm being pivotally coupled to said shaft such that said holding arm extends through said opening when it is selectively pivoted between a first configuration perpendicular to one planar side of said body member and a second configuration perpendicular to a second planar side of said body member.

6. The paint container support device as in claim 5 further comprising:

first means for releasably locking said holding arm in said first configuration; and second means for releasably locking said holding arm in said second configuration.

7. A paint container support device for use with a ladder having a plurality of hollow rungs extending between a pair of spaced apart rails, said paint container support device, comprising:

a hook member including an upper portion having a generally inverted U-shaped configuration and defining an opening such that said upper portion is adapted to be suspended from a selected rung of the ladder, said hook member having a lower portion adapted to receive a bail of a paint container;

a body member integrally connected to said lower portion of said hook member and depending therefrom, said body member having elongate front and rear edges with first and second planar side walls extending therebetween;

wherein said body member defines a cutout between said side walls;

a shaft positioned in said cutout; and a holding arm having a first end releasably coupled to said shaft and having a second end, said holding arm being configured for selective insertion second end first into a hollow rung of the ladder, whereby to position said hook and body members outwardly adjacent a respective rail of the ladder.

8. The paint container support device as in claim 7 further comprising a plurality of elongate support strips, each support strip adapted to be releasably connected to said rear edge and extend longitudinally therealong, each elongate support strip having a thickness different than a thickness of any other support strip for displacing a respective paint container a respective distance from said body member such that a corresponding bail is held substantially perpendicular relative to said respective paint container when said corresponding bail is received by said lower portion of said hook member.

9. The paint container support device as in claim 7 wherein said rear edge of said body member is rearwardly offset from said lower portion of said hook member such that said bail is held generally perpendicular to said paint container when said bail is received by said lower portion of said hook member.

10. The paint container support device support device as in claim 7 wherein:

said shaft is positioned vertically in said cutout;

said front edge of said body member defines an opening in communication with said cutout; and said first end of said holding arm is pivotally coupled to said shaft such that said holding arm is selectively movable between a first configuration perpendicular to said first planar side wall and a second configuration perpendicular to said second planar side wall, said holding arm passing through said opening when pivotally moved between said first and second configurations.

11. The paint container support device as in claim 10 further comprising: first means for releasably locking said holding arm in said first configuration; and second means for releasably locking said holding arm in said second configuration.

12. A paint container support device for use with a ladder having a plurality of rungs extending between a pair of spaced apart rails, said paint container support device, comprising:

a hook member having an upper portion adapted to selectively engage a rung of the ladder and a lower portion adapted to receive a bail of a paint container;

a body member fixedly attached to said lower portion of said hook member and having an elongate rear edge adapted to support said paint container in a vertical configuration when said bail thereof is received by said lower portion of said hook member; and a plurality of elongate support strips, each support strip being singly coupled to said rear edge and extending longitudinally therealong, each elongate support strip having a thickness different than a thickness of any other support strip for displacing a respective paint container a predetermined distance from said body member such that a corresponding bail is held substantially perpendicular relative to said respective paint container when said corresponding bail is received by said lower portion of said hook member.

13. The paint container support device as in claim 12 wherein said body member defines a cutout; said paint container support device further comprising:

a shaft positioned in said cutout; and a holding arm having a first end releasably coupled to said shaft and having a second end, said holding arm being configured for insertion second end first into a hollow rung of a ladder, whereby to position said hook and body members outwardly adjacent a respective rail of the ladder.

14. The paint container support device as in claim 13 wherein said body member includes a front edge opposite said rear edge and defining an opening in communication with said cutout, said first end of said holding arm being pivotally coupled to said shaft such that said holding arm extends through said opening when it is selectively pivoted between a first configuration perpendicular to one planar side of said body member and a second configuration perpendicular to a second planar side of said body member.

15. The paint container support device as in claim 13 further comprising: first means for releasably locking said holding arm at said first configuration; and second means for releasably locking said holding arm at said second configuration.

* * * * *